United States Patent [19]

Casada

[11] Patent Number: 4,460,063

[45] Date of Patent: Jul. 17, 1984

[54] STEP-LADDER WORK BENCH

[76] Inventor: Edwin I. Casada, 271 Salisbury Sq., Apt. 103, Louisville, Ky. 40207

[21] Appl. No.: 367,571

[22] Filed: Apr. 12, 1982

[51] Int. Cl.[3] ..... E06C 7/14

[52] U.S. Cl. ..... 182/116; 248/238

[58] Field of Search ..... 182/116, 124, 129; 248/238

[56] References Cited

U.S. PATENT DOCUMENTS

| | | | |
|---|---|---|---|
| 272,540 | 2/1883 | Gartrell | 182/124 |
| 467,685 | 1/1892 | Hammon | 182/116 |
| 909,825 | 1/1909 | Robertson | 182/124 |
| 2,962,111 | 11/1960 | McKinnie | 182/116 |

*Primary Examiner*—Reinaldo P. Machado

[57] ABSTRACT

A step ladder work bench apparatus for significantly increasing the top shelf area on step ladders. Apparatus is hingedly attached to said step ladder allowing apparatus to be raised and hooked in place for use and lowered against step ladder rails for storage.

1 Claim, 4 Drawing Figures

STEP-LADDER WORK BENCH

This invention relates to step ladders and more particularly to an improved folding work top for all types and sizes of step ladder.

The problem of providing a strong and larger work area at the top of step ladders has faces the art for many years, and to which a number of solutions have been proposed. Typical of these proposed solutions are those exemplified in U.S. Pat. No. 909,825 to J. B. Roberton. This patent provides an extension for the top of step ladders but such extensions are not satisfactory for a number of reasons. First, such extensions are hinged at the top of the step ladder and the hinged arm offers no support for any added weight that might be placed on the extension, support for added weight is from leverage against the underside of the step ladder top. Second, this patent solves only part of the problem in that it only increases the width of the step ladder top and not the length, and also leaves a crack across the work top. Third, this patent would be a problem for the average person to attach to the step ladder they now own, as it requires complicated alteration to the ladder top by adding side boards that extend pointedly beyond the front edge of the step ladder top. These pointed ends could be a safety hazard to the user by snagging clothes when ascending and descending the step ladder. Fourth, this patent would be workable only on wood step ladders as it requires the step ladder top to overhand the side rails as only wood step ladders do. This patent and other prior art such as U.S. Pat. No. 272,540 to M. G. Gartrell, U.S. Pat. No. 467,685 to E. W. Hammon, and U.S. Pat. No. 2,962,111 to R. C. McKinnie require specially manufactured parts and some the complete ladder, making the cost to the consumer prohibitive.

The principal object of the present invention is to overcome all the problems of the prior art. This instant invention provides a one piece work bench top that is wider and longer, also substantially braced to support any reasonable weight that is placed on it. This invention is very easy to attach to any type or size step ladder.

Other objects are the apparent ease in which this invention is unfolded for use and folded for storage. Very light in weight and requires no specially manufactured parts, and it is very strong. It is also attractive in structure and cost to the consumer. This invention can be removed and attached to a different size step ladder quickly and easily.

In a preferred embodiment of my invention, I provided a step ladder work bench comprising of two elongated mounting members adapted for pivotal attachment to the back rails of the step ladder at points which allow work bench to be pivoted to the top of step ladder and then hooked in a level position. Elongated mounting arms then become braces, set at an angle that transfer the weight on work bench top back to the step ladder legs. Brace hooks, that attach work bench to step ladder top are also elongated braces to strengthen work bench top. Elongated mounting members also pivot to allow work bench to be folded flat against the back of the step ladder when not in use or for storage.

In the foregoing general description I have set out certain objects, purposes and advantages of my invention. Other objects, purposes and advantages of the invention will be apparent from the following description and the accompanying drawing in which.

Figure 1:
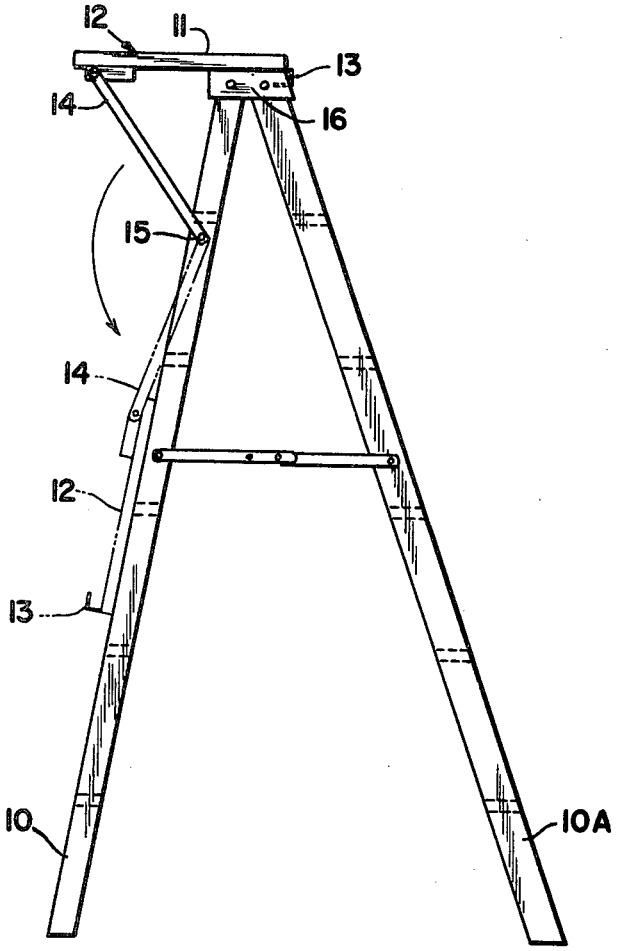
FIG. 1 is a orthographic sideview of a step ladder showing work bench top in two position, folded and unfolded.
Figure 3:
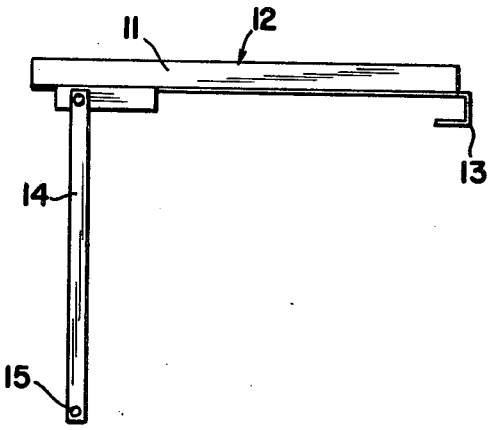
FIG. 3 is a orthographic side view of work bench top showing elongated mounting braces and elongated brace hooks.
Figure 4:
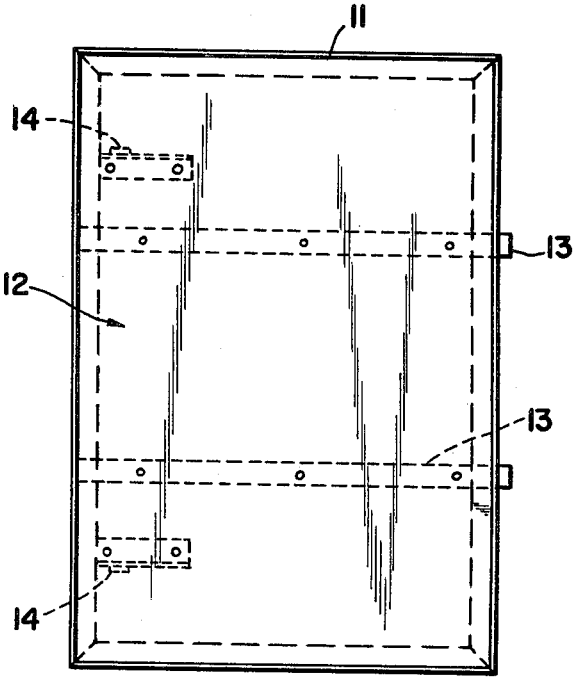
FIG. 4 is a isometric view of the work bench top.
Figure 2:
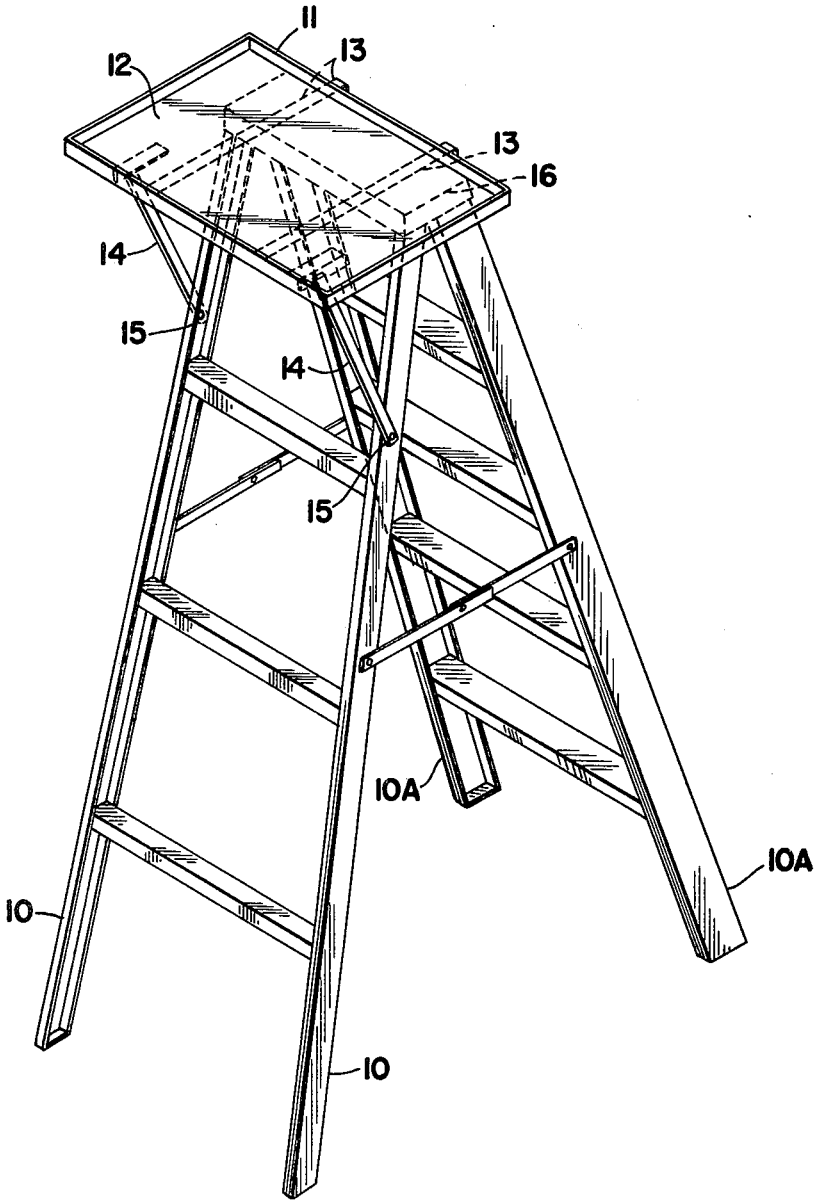
FIG. 2 is a isometric view showing how work bench top sits on top of step ladder.

Referring to the drawings I have illustrated a standard aluminum step ladder having back ladder rails 10 with braces and front ladder rails 10-A with steps. The ladder rails 10 and 10-A are formed of extruded metal.

The step ladder work bench has two elongated mounting arms 14 which are attached to the back ladder rails 10 by two pivot bolts 15 at a given point. Mounting arms 14 are hingedly attached to work bench top 12. Work bench top 12 is pivoted up and down by the hinged mounting arms 14. Work bench top 12 is provided with two elongated brace hooks 13 that attach work bench top 12 to the step ladder top 16. Work bench top 12 is provided with a raised flange 11 around outside edge to prevent articles from falling off work bench top 12.

The work bench is used in the following manner:

After work bench is attached to ladder rails 10 by mounting arm braces 14, user lifts work bench from a folded position to the top of step ladder, bringing work bench top 12 back far enough to engage brace hooks 13 with step ladder top 16. Work bench should now be level and sitting firmly on top of the step ladder. When not in use reverse the procedure and fold work bench top 12 down against the back ladder rails 10.

The embodiments of the invention in which an exclusive property or privilege is claimed are defined as follows:

1. In combination with a step ladder comprising a top platform section, a step section attached to the front end of said top platform section and a prop section attached to the rear end of said top platform section, a work bench attachment comprising a shelf section, two elongated mounting arms pivotally attached at one end to said prop section and at their other end to one end of said shelf section, brace hook means attached to the bottom of said shelf section and having hook portions, extending downwardly and located at the opposite end of said shelf section and adapted to engage the front end of said top platform section when the work bench is in operative position with said shelf section resting on said top platform section.

* * * * *